US005107742A

United States Patent [19]

Cummings et al.

[11] Patent Number: 5,107,742

[45] Date of Patent: Apr. 28, 1992

[54] SHIFTABLE SNARE STRAINER FOR A DRUM

[75] Inventors: John Cummings, Monroe; Fred Mills, Mt. Pleasant; Richard Gerlach, Monroe; Glenn Strawn, Peachland, all of N.C.

[73] Assignee: Selmer Corporation, Elkhart, Ind.

[21] Appl. No.: 578,559

[22] Filed: Sep. 4, 1990

[51] Int. Cl.[5] ..... G10D 13/02

[52] U.S. Cl. ..... 84/415

[58] Field of Search ..... 84/411 R, 415, 416, 84/147

[56] References Cited

U.S. PATENT DOCUMENTS 2,430,184 3/1945 Peacock ..... 84/411 R

*Primary Examiner*—Brian W. Brown
*Assistant Examiner*—Khanh Dang
*Attorney, Agent, or Firm*—James D. Hall

[57] ABSTRACT

A shiftable snare strainer for a snare drum including a body secured to the drum shell and a slide longitudinally shiftable relative to the body. The slide is connected at its lower end to the snares. A lock is pivotally carried by the body for engaging the slide to hold the slide in a down position wherein the snares are spaced from the head. The lock is released by striking a release pad to allow the slide to shift upwardly to engage the snares with the drumhead.

7 Claims, 5 Drawing Sheets

SHIFTABLE SNARE STRAINER FOR A DRUM

FIELD OF THE INVENTION

This application relates to a snare drum strainer and has specific relevance to a shiftable snare drum strainer.

BACKGROUND OF THE INVENTION

Snare drums have long been a popular percussion instrument and typically include a drum shell having upper and lower drumheads adjustably connected to the shell by foundation pillars and tension bolts. A snare strainer assembly is connected to the shell so that a plurality of individual snares are carried just below the lower drumhead to vibrate against the lower head and produce the "snare" sound when the upper drumhead is struck. The snares are connected at one end to a snare anchor and at the other end to an adjustable snare strainer which allows a percussionist to adjust the tension on the snares to obtain a crisp snare sound.

It is often desirous to shift the snares of a snare drum away from the lower drumhead so that the drum when struck will produce a "tom-tom" sound. It is also desirous to be able to switch the snares rapidly back into contact with the head. This is especially true with field drums commonly used in marching bands and drum and bugle corps.

Heretofore, shiftable snare strainers have relied on a hinged arm and over center latch arrangement radially shiftable between locked up position wherein the snares vibrate against the lower drumhead and a down position wherein the snares are spaced from the head. Problems associated with the prior art shiftable snare strainers are two fold. First the radial movement of the arm requires excessive movement by the percussionist. This is especially bothersome while the percussionist is playing and needs to rapidly switch between the tom-tom and snare sounds of the drum. Secondly, the prior art snare strainers use an over-center latch arrangement to lock the handle and the snare strainer in the up or snare position. This over-center locking arrangment places excessive stress on the snares thereby presenting great difficulty in maintaining consistent pressure on the snares over repeated cycling of the strainer between the tom-tom snare positions. Without continued adjustment of the tension on the snares, the snare sound becomes loose and unappealing.

SUMMARY OF THE INVENTION

The shiftable snare strainer of this invention eliminates the problems above by providing a longitudinally shiftable strainer for disengaging and re-engaging the snares which is lockable only in the down position. Spring tension alone holds the strainer in the up position. The shiftable snare strainer includes a stationary body and a slide. The slide includes a pair of channels which slidably accommodates rollers carried by the stationary body to shiftably connect the slide to the stationary body. The slide is longitudinally shiftable relative to the body between a down and locked position and an up position. A locking arm pivotal in a plane transverse to the movement of the slide is carried by the stationary body for engaging an inner surface of the slide and lodging within a cavity formed in the inner surface to lock the slide down. The slide is connected at its lower end to the snares such that as the slide is in its up position the snares engage the drum's lower head. When the slide is in its down and locked position the snares are spaced from the drum's lower head. A spring is positioned between the top of the stationary body and the slide top wall to bias the slide toward its up position. A lock release or strike pad is connected to the locking arm and extends outwardly of the slide. To disengage the snares from the drumhead, a percussionist pushes downwardly on the slide top wall to shift the slide longitudinally until the locking arm snaps into engagement with the slide cavity thus locking the slide down. To release the slide and re-engage the snares, the percussionist strikes the release pad sharply with either his hand or drumstick causing the locking arm to disengage the slide cavity to release the slide. With the locking arm free of the slide cavity, the spring between the slide and stationary body causes the slide to shift quickly upwardly to position the snares in engagement with the drumhead. A longitudinal screw adjustably connected to the stationary body and extending upwardly through the slide top wall regulates the upper limit of the slide. Since the slide is biased into its up position by a spring and not locked as with prior art shiftable strainers, excessive force is not applied an the snares. Therefore, in using the shiftable snare strainer of this invention, continued adjustment of the pressure on the snares is not required to maintain a desired sound. Further the strike release feature of the invention provides an improved quick release action.

Accordingly, it is an object of this invention to provide for a novel shiftable snare strainer.

Another object of this invention is to provide for a snare strainer wherein the body and slide parts are longitudinally shiftable.

Another object of this invention is to provide a shiftable snare strainer having a quick release to shift the snares into engagement with the lower drumhead.

Other objects of the invention will become apparent upon a reading of the following description taken with the accompanying drawings.

BRIEF DESCRIPTION OF THE DRAWINGS

FIG.. 1 is a perspective view of the shiftable snare strainer of this invention connected to a drum only partially shown for illustrative purposes.

DESCRIPTION OF THE PREFERRED EMBODIMENT

Figure 1:
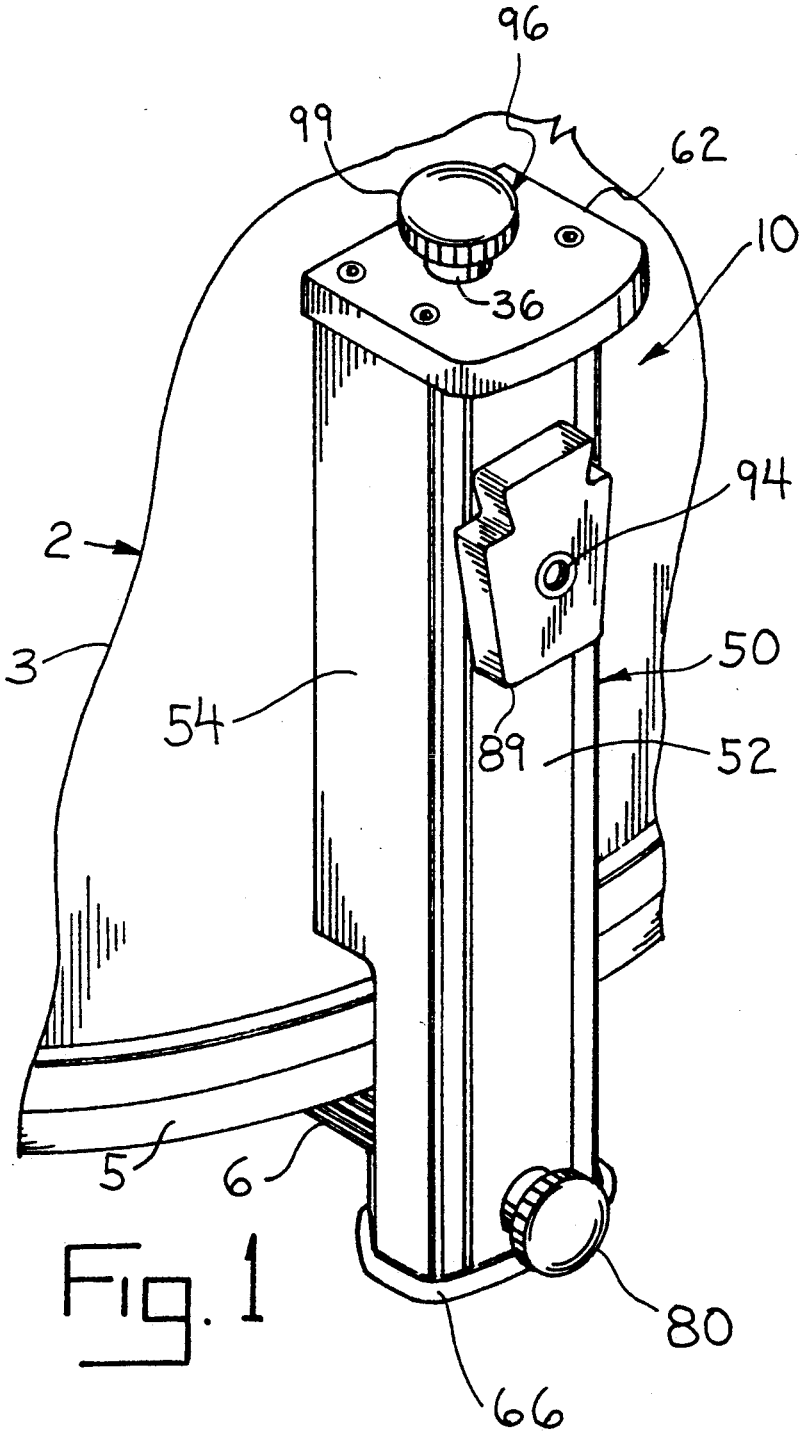

The preferred embodiment herein described is not intended to be exhaustive or to limit the invention to the precise form disclosed. Rather, it is chosen and described in order to best explain the invention so that others skilled in the art may utilize its teachings.

Referring now to the figures, a typical snare drum 2 is partially illusrated which includes as its major components a shell 3, covered at each open end by drumheads 4 and rims 5. Rims 5 are adjustably connected as is common to shell 3 by foundation pillars and tension bolts (not shown). Snares 6 are stretched across the lower drumhead 4 and are adapted for connection at one end to a stationary snare anchor (not shown) and at the other end to the shiftable snare strainer 10 of this invention.

Figure 5:
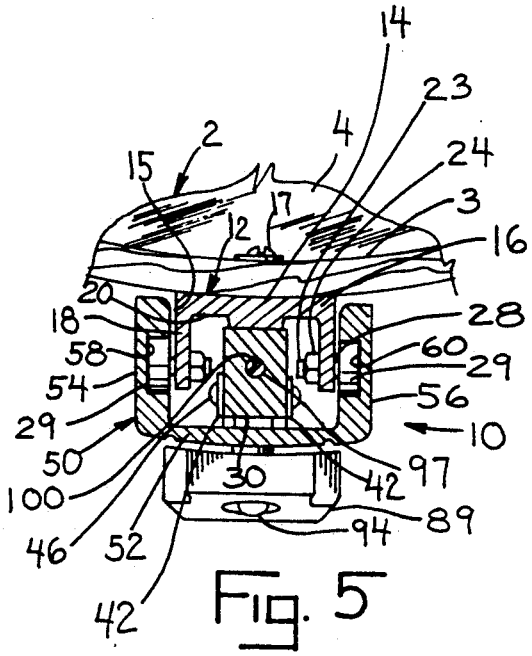
FIG. 5 is a cross-sectional view of the shiftable snare strainer taken along line 5—5 of FIG. 4.

Snare strainer 10 includes an elogated body 12 having as integral components a longitudinal back wall 14 and side walls 16, 18 extending perpendicularly from back wall 14. The outer surface 15 of back wall 14 is arcuate in cross section to fit against cylindrical drum shell 3 (See FIG. 5). A longitudinal central rib 20 extends along back wall 14 parallel with the spaced side walls. A pair of threaded bores 15 are formed through rib 20 and back wall 14. Screws 17 extend through aligned bores in shell 3 and are turned within bores 15 of body 12 to attach body 12 to the drum.

Figure 6:
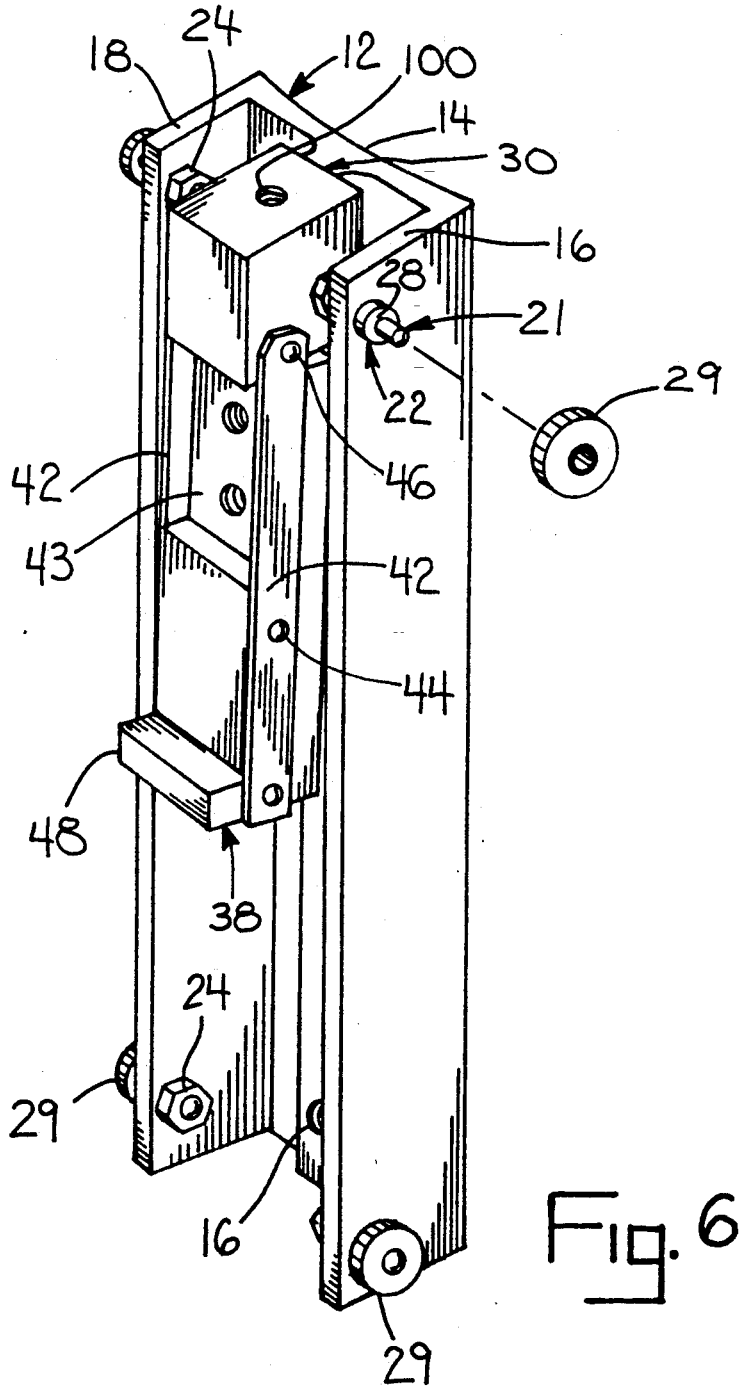
FIG. 6 is exploded perspective view of the body portion of the invention.

Four axles 22 (see FIG. 6) are carried by body 12 and each include a threaded portion 23, unthreaded portion 21 and collar 28. The threaded portion 23 of each axle is inserted through a bore 27 in side walls 16, 18 until its collar 28 abuts the outer surface of the side wall. Each axle is secured to the side walls by a nut 24. As illustrated the unthreaded portions of axles 22 extend outwardly from side walls 16, 18 as illustrated. A roller bearing 29 is journalled upon each axel 22.

A block 30 is connected to body 12 by screws 32 adjacent one end 34 of the body. Block 30 includes a threaded longitudinal bore 36. A locking arm 38 having a L-shaped body 40 is pivotally connected to head 30 by links 42 at a pivot pin 46. Links 42 are connected on opposite sides of body 40 by fasteners 44 (See FIG.6). L-shaped body 40 includes an upper recess 43 and a foot 48. A pair of bores extend transversely through body 40 from recess 43. A bore 41 extends into body 40 a partial distance from the rear of body 40 near the foot end of the body. A similar bore 21 is formed in rib 20 of body 12 in alignment with bore 37. A helical spring 39 is accommodated at each end by bores 21, 41 to normally bias locking arm 38 away from body 12.

Slide 50 includes as integral components front wall 52 and side walls 54, 56. Slide 50 has a general C-shaped cross section. Side wall 54 and 56 included longitudinal channels 58, 60 respectively. Channels 58, 60 are in opposing alignment, opening to the interior of the slide. A top wall 62 is connected to the upper end of slide 50 by screws or similar fasteners (not shown). Similarly a bottom wall 66 is connected at the lower end of slide 50 by screws or similar fasteners also not shown. Front wall 52 of slide 50 includes an inner surface 70 and an outer surface 72. A rectangular opening 74 is formed through wall 52. A cavity 76 is formed in wall 52 at inner surface 70 below opening 74. A bore 78 is formed through top wall 62.

Figure 3:
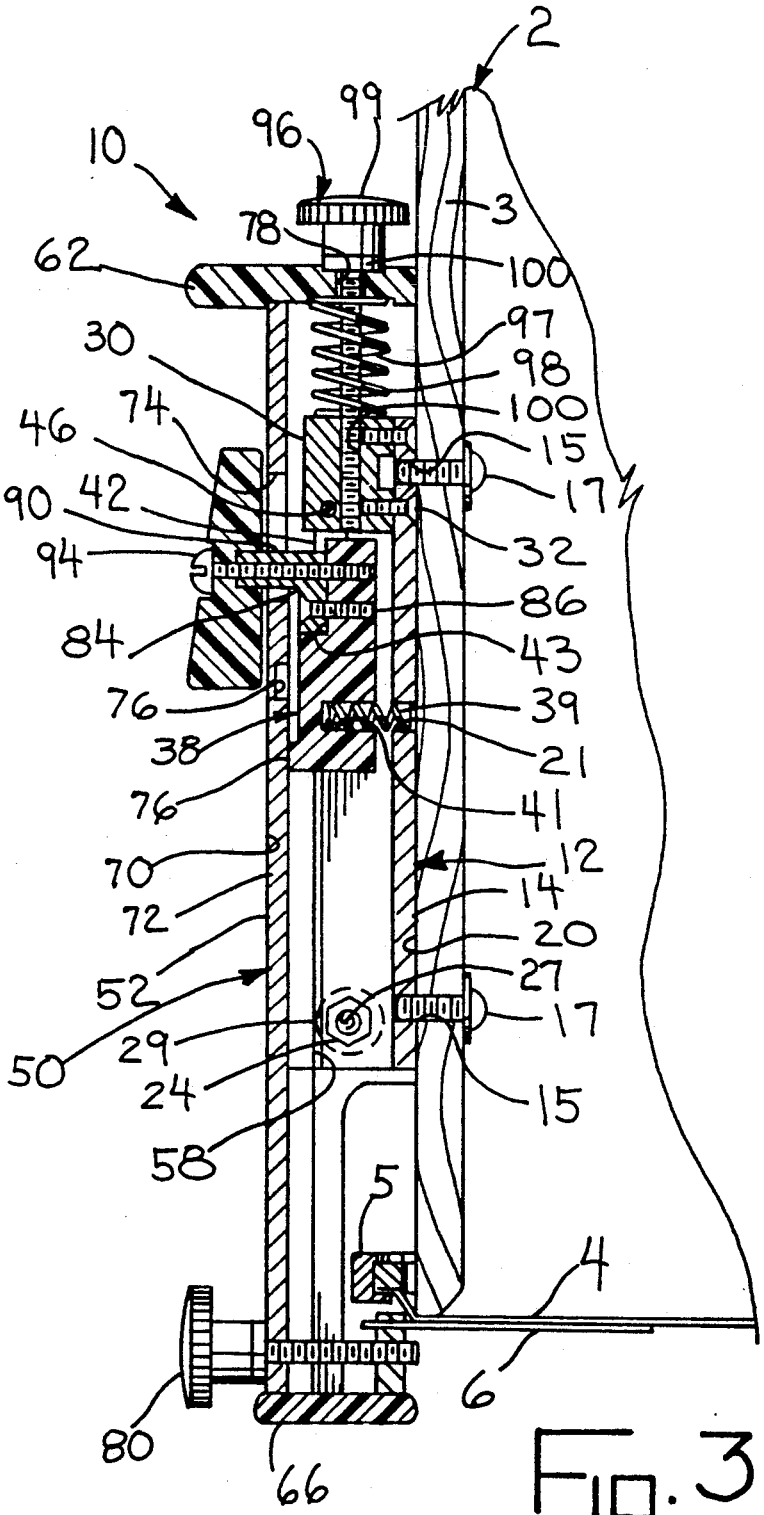
FIG. 3 is a longitudinal sectional view of the snare strainer of FIG. 2.

Slide 50 is shiftable carried by stationary body 12 with roller bearing 29 accommodated within channels 58, 59 of the slide. After the slide is positioned on the body, a post 84 is connected to locking arm 38 by screw 86 with the extension protecting through rectangular opening 74 of slide 50. A strike pad 89 is connected to extension 84 by a screw 94. The shank 97 of a thumb screw 96 extends through top wall opening 78 and is screwed into bore 36 of block 30 to connect body 12 and slide 50. Screw 96 when turned relative to block 30 regulates the fully up position of the slide. A washer 100 extends about the shank 97 of screw 96 and is located between the screw head 99 and slide top wall 62. A helical spring 98 is carried by screw shank 97 between top wall 62 and head 30 so as to normally bias the slide into its upper position as seen in FIG. 3. A snare tension adjustment screw 80 extends through wall 62 near bottom wall 66 for connection to one end of the snares 6 as shown.

Figure 2:
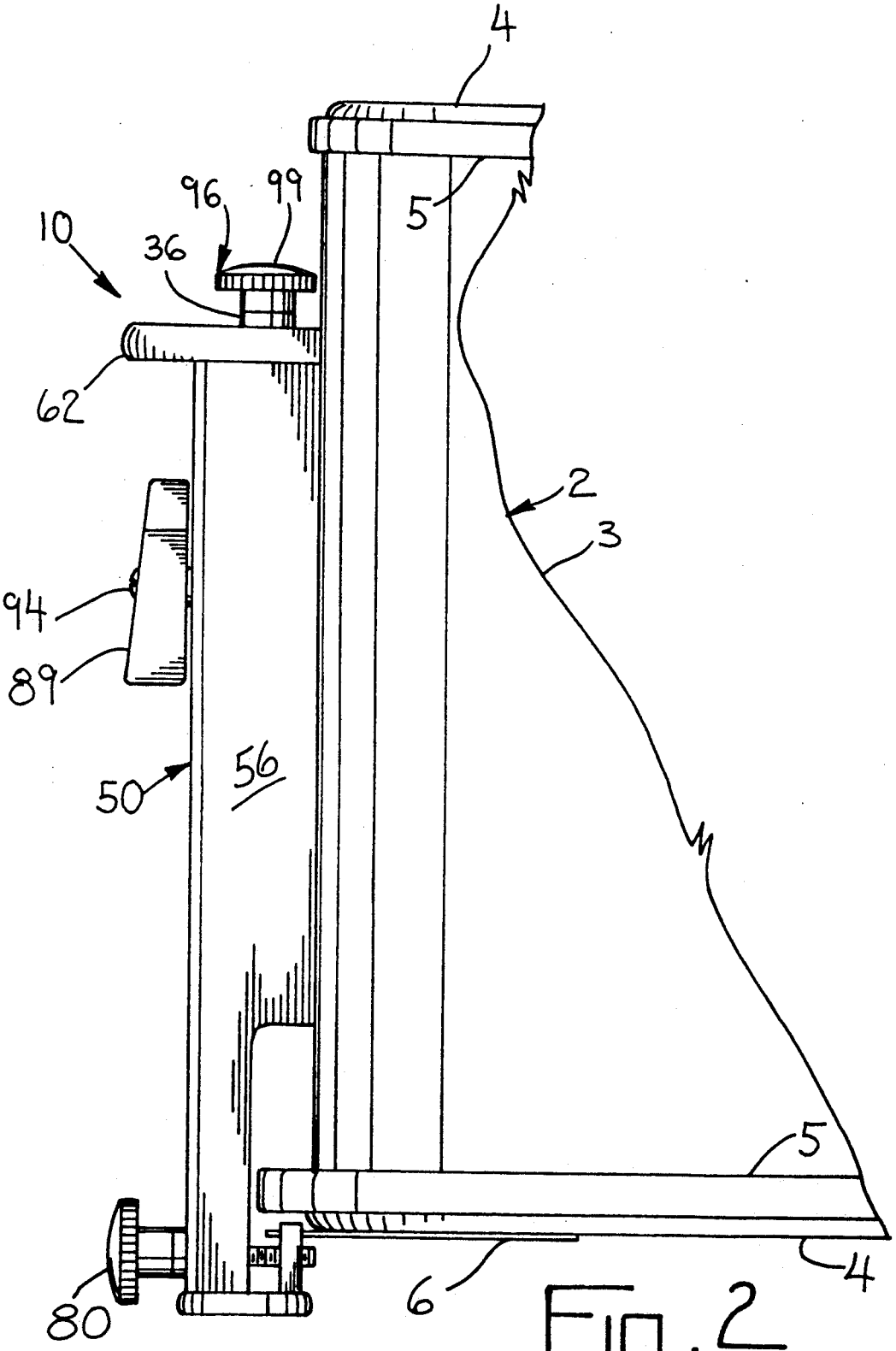
FIG. 2 is a side elevational view of the snare strainer of FIG. 1.
Figure 4:
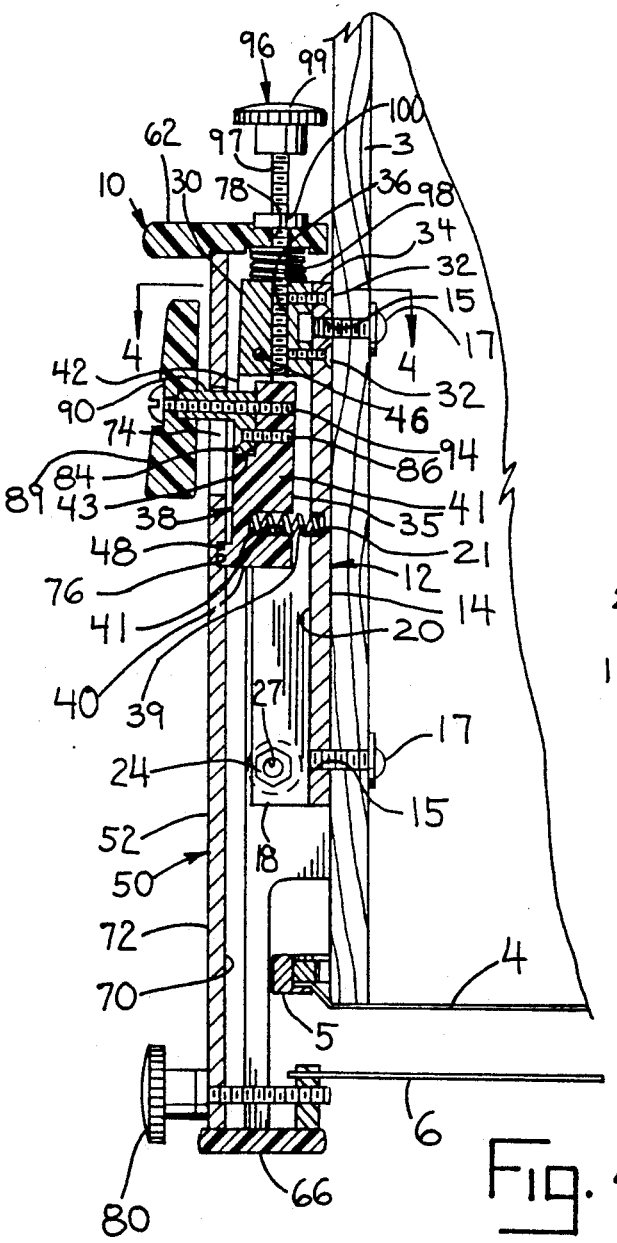
FIG. 4 is a sectional view like FIG. 3 but with the shiftable snare strainer in its down and locked position.

The slide 50 is shiftable relative to the stationary body 12 between an up position regulated by screw 96 and a down and locked position. In the up position of FIGS. 2 and 3, snares 6 are adjacent the lower head 4 to produce the "snare" sound when the upper drumhead 4 is struck. In the down position of FIG. 4, the snares 6 are spaced from the lower drumhead 4 which causes the drum 2 to produce the "tom-tom" sound when struck.

To shift the slide into its down and locked position the user pushes downwardly on the projecting lips 63 of top wall 62 causing slide 50 to shift relative to stationary body 12. As slide 50 shifts, foot 48 of locking arm 38, biased outwardly by spring 38, contacts the inner surface 70 of slide front wall 52 and enters cavity 76. With foot 48 protruding into cavity 76 the slide is locked into the position of FIG. 4. In the locked position, spring 98 between the top wall 62 and head 30 is compressed to put upward pressure on the slide.

To release the slide 50 and engage the snares 6 with the lower drumhead 4, a percussionist strikes strike pad 89 with either his hand or drumstick which urges locking arm 38 rearwardly away from slide front wall 52 to disengage foot 48 from cavity 76. With the foot briefly removed from the cavity, spring 98 urges slide 50 rapidly upward until top wall 62 abuts flexible washer 100 which is forced against screw head 99. Therefore the snares maybe quickly disengaged by pushing downwardly on the slide 50 and quickly re-engaged by striking strike pad 89. By locking the slide only in the down position and relying only on spring pressure to raise the slide excessive force is not placed on the snares when engaged. A percussionist can therefore adjust the tension of the snares 6 for a specific sound quality and rest assured that the tension will not be adversely effected by repeated cycling of the snare strainer.

It should be understood that the invention is not to be limited to the precise form disclosed but may be amended within the scope of the appended claims.

We claim:

1. A shiftable snare strainer adapted for connection to snares on a snare drum having a lower drumhead for selectively engaging and disengaging the snares with said drumhead, said shiftable snare strainer comprising;

a body adapted to be secured to said drum, a slide being shiftably connected to said body and adapted for connection at one end to said snares, said slide being longitudinally shiftable relative to said body between a first position wherein said snares contact said drumhead and a second position wherein said snares are spaced from said drumhead, locking means connected to said body and engageable with said slide for locking said slide upon said shiftable movement in its said second position, release means carried by said body for disengaging said locking means, and biasing means operatively associated with said slide for only urging said slide in its said first position when said locking means is disengaged.

2. The shiftable snare strainer of claim 1 wherein said slide includes an inner surface having a recess, said locking means includes a foot in biased engagement with said slide inner surface, said recess being spaced from said foot with said slide in its said first position, said foot engaging with said recess with said slide in its said second position.

3. The shiftable snare strainer of claim 2 wherein said release means being connected to said locking means and extending outwardly of said slide, said release means including a pad means for disengaging said foot from said recess to release said slide and disengage said locking means.

4. The shiftable snare strainer of claim 1 wherein said biasing means includes a spring means carried between said body and said slide for biasing said slide into its said first position.

5. A shiftable snare drum strainer for connection to a snare drum to shift one end of the snare drum's snares between inoperative and operative positions with a lower drumhead of said snare drum, said shiftable snare drum strainer comprising:

a body attached to a side of said snare drum, said body including a pair of spaced rollers, a lock partially carried by said body and biased toward said slide front wall, said lock including a foot, a slide having a pair of spaced side walls extending from a front wall and a top wall a each of said side walls including a longitudinal channel, said slide front wall having an inner surface with a recess therein, said rollers of said body positioned within said channels to shiftably connect said slide to said body, said slide being shiftable between a first position with said recess spaced from said foot and said snares in there said operative position and a second position with said recess engaged by said foot to secure said slide in said second position and said snares in their said inoperative position, and release means for urging said foot out of engagement with said recess to allow said slide to shift from its first to its second position.

6. The shiftable snare drum strainer of claim 5 further including an adjustable stop member means carried by said body and engaging said slide for determining said first position of the slide.

7. The shiftable snare drum strainer of claim 5 further including a spring positioned between said body and said slide top wall for biasing said slide toward its said first position.

* * * * *